US006478268B1

(12) United States Patent
Bidwell et al.

(10) Patent No.: US 6,478,268 B1
(45) Date of Patent: Nov. 12, 2002

(54) DISPLAY STAND FOR MERCHANDISING CHILLED PRODUCTS AND THE LIKE

(75) Inventors: Christopher C. Bidwell, Atlanta, GA (US); Rebecca J. Bidwell, Dunwoody, GA (US); Andrew J. Covault, Cumming, GA (US); Keith Harbour, Springfield, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/619,304

(22) Filed: Jul. 19, 2000

Related U.S. Application Data

(60) Provisional application No. 60/172,282, filed on Dec. 17, 1999.

(51) Int. Cl.[7] ..... F16M 11/00

(52) U.S. Cl. ..... 248/174; 248/152; 248/459; 248/535; 62/457.1

(58) Field of Search ..... 248/459, 460, 248/461, 174, 150, 152, 535, 539; 40/124.06; 211/74, 72; 220/592.19; 62/457.1

(56) References Cited

U.S. PATENT DOCUMENTS

| | | | | |
|---|---|---|---|---|
| 3,532,310 A | * | 10/1970 | Finfrock | 248/535 |
| 4,610,363 A | | 9/1986 | Flum et al. | 211/74 |
| 4,662,107 A | * | 5/1987 | Van Den Kieboom | 47/84 |
| 4,724,682 A | | 2/1988 | Flum et al. | 62/462 |
| 4,911,311 A | * | 3/1990 | Nagai | 211/126 |
| 4,946,032 A | * | 8/1990 | Stoddard et al. | 248/174 X |
| 5,000,717 A | * | 3/1991 | Pfeiffer | 40/539 |
| 5,029,708 A | * | 7/1991 | Alonso et al. | 248/174 X |
| 5,048,171 A | | 9/1991 | Bidwell et al. | 29/401.1 |
| D323,267 S | | 1/1992 | Bidwell | D7/606 |
| D326,800 S | | 6/1992 | Flum | D7/606 |
| D326,801 S | | 6/1992 | Flum | D7/606 |
| 5,372,342 A | * | 12/1994 | Adams | 248/150 X |
| D354,640 S | | 1/1995 | Flum | D6/450 |
| 5,596,880 A | * | 1/1997 | Welker et al. | 40/607 X |
| 6,149,111 A | * | 11/2000 | Epstein | 40/124.06 |

OTHER PUBLICATIONS

Display Equipment Catalog "The Dump Bin" (Spring 1985).
Display Equipment Catalog "Cold Product Display Barrel" (Spring 1995).
Display Equipment Catalog "Cooler–N–Stand" (Spring 1985).
Display Equipment Catalog "Woodland Barrel" (Spring 1985).

* cited by examiner

*Primary Examiner*—Leslie A. Braun
*Assistant Examiner*—Tan Le
(74) *Attorney, Agent, or Firm*—Blackwell Sanders Peper Martin LLP

(57) ABSTRACT

A display stand for supporting a conventional cooler chest or other product holding container including a first member foldable to form a shell for receiving the cooler chest, a second member positionable within the shell for supporting the cooler chest when positioned thereon, and a third member positionable within the shell providing a floor surface for holding the cooler chest, the third member being located within the shell such that the shell wraps around the side walls of the cooler chest when the cooler chest is positioned on the third member. The third member further includes an extension portion foldable to form a drain spout, the drain spout being positionable through a door assembly associated with the first member for funneling the waste water away from the cooler chest to a suitable container positioned exterior of the display stand.

29 Claims, 5 Drawing Sheets

DISPLAY STAND FOR MERCHANDISING CHILLED PRODUCTS AND THE LIKE

CROSS-REFERENCE TO RELATED APPLICATION

This application is based on and claims priority of Provisional Patent Application Ser. No. 60/172,282 of Bidwell et al, for DISPLAY STAND FOR MERCHANDISING CHILLED PRODUCTS AND THE LIKE, filed Dec. 17,1999, which is hereby incorporated by reference.

TECHNICAL FIELD

This invention relates generally to product merchandising units for use in storing and displaying a wide variety of products to consumers and, more particularly, to a foldable board type structure adapted to be configured into a display stand for holding a conventional cooler chest or other product holding container, the present display stand in combination with a cooler chest or other container forming a point of sale product merchandising unit for holding and merchandising chilled products therefrom.

BACKGROUND OF THE INVENTION

In the merchandising of single unit products such as bottled or canned soft drink and fruit juice type beverages and, particularly, those impulse items which are desired pre-chilled by customers and are normally sold in single units, there is always a need to have a product merchandising unit which will accommodate the storing and chilling of a reasonable number of such articles for easy access by prospective customers. This is particularly true in our fast-moving and highly mobile society where pre-chilled soft drink and fruit juice products are routinely purchased for consumption on the go. As a result, point-of-sale merchandising units are widely used because they offer greater flexibility in the choice of where such merchandising units may be located since the strategic location of such units can have a great impact on the volume of sales of the articles or products contained therein. Proper utilization of merchandising areas is extremely important to merchants who handle a wide variety of products, particularly, chilled products such as numerous bottled and canned soft drink and fruit juice products, since effective use of these areas promote sales.

It is therefore desirable to provide a point-of-sale merchandising unit which is quick and easy to assemble, inexpensive to manufacture, easy to move from one merchandising location to another location, and is relatively lightweight yet sturdy and reusable.

SUMMARY OF THE INVENTION

The present invention teaches the construction and use of a relatively simple and economical display stand which is easily assembled and is specifically designed to hold and support a conventional cooler chest for merchandising chilled products at any selected point-of-sale location within a merchandising environment. More particularly, the present display stand includes several flexible board type components which, when assembled, form an attractive display stand having an opening or cavity associated therewith adaptable for receiving and holding a conventional cooler chest therewithin. When positioned within the present display stand, the side walls of the cooler chest are substantially hidden and contained within the present display whereas only the hinged cooler top is visible to the consumer. The main component of the present display stand includes a substantially flat sheet of board material, preferably a corrugated flexible plastic board material, which is scored or otherwise bendable at various intermediate locations thereallong such that the flat sheet can be formed into a substantially rectangular shell which is sized and dimensioned so as to substantially conform to and wraparound the rectangular or other shape of the particular cooler chest which will be positioned therewithin. The overall height of the formed cooler shell can vary depending upon the particular merchandising application, but should be of sufficient height such that the top portion of the cooler chest positioned therewithin will be at a convenient height for consumers to access the chilled products positioned within the cooler chest. When formed into the rectangular or other shaped shell, the opposed end portions of this main component are attached by any suitable attachment means. It is also anticipated that the opposed end portions of the cooler shell could be integrally formed together such that the cooler shell comprises a one-piece component foldable, bendable or otherwise formable into the appropriate configuration.

The present display stand also includes a second component which comprises a support structure positionable within the opening defined by the formed shell, the support structure being preferably attachable to the main component and being adaptable for supporting both a floor member and the cooler chest when such members are positioned thereon. The present support structure is likewise preferably comprised of a corrugated flexible plastic board material and may be unitary in structure, or such support structure may be comprised of a plurality of members such as two overlapping interconnecting board members. A floor member which comprises the third component of the present display stand is positioned and located on top of the support structure within the formed shell and is likewise adaptable for holding a cooler chest or other suitable product holding container. When the cooler chest is positioned on the floor member, the cooler chest is substantially housed within the shell and only the hinged top cover of the cooler is visible to the consumer.

The main sheet member forming the present display stand, when formed into a rectangular or other shaped shell, includes a pair of cutouts adjacent the top portion of two opposed side panels of the formed shell, the cutouts being adaptable to receive the handle members associated with the cooler chest such that the handle members extend through such cutouts and are accessible exterior of the present display stand. One side portion of the formed main component likewise includes a foldable door assembly which is positioned and located so as to receive therethrough an elongated extension of the floor member, such elongated extension being capable of being formed into a spout or trough for directing and channeling melted waste water accumulated within the cooler chest from the cooler to a suitable container for disposal thereof. The formed spout member is correspondingly positioned and located so as to coincide with the drain plug associated with the cooler chest.

The main sheet component may likewise include a plurality of optional flap members associated with one side panel of the formed shell, preferably the rear side panel thereof, the plurality of flap members being positionable to hold and support a pole sign when engaged therewith, the pole sign having graphics or other signage associated therewith for advertising the particular type of products being merchandised from the cooler chest.

In use with a conventional cooler chest, the present display stand provides simple and efficient means for effectively displaying and merchandising individual bottles or cans of soft drink and fruit juice products as well as other products to consumers. Because the present display stand is made of lightweight flexible board material, it can be easily moved from one location to another. This is accomplished by simply lifting up on the handle members associated with the cooler chest which extend through the cutouts associated with the formed wraparound shell, and thereafter transporting the entire display stand along with the cooler chest positioned therewithin to a new merchandising location. In addition, the front panel of the formed cooler shell may likewise include high visibility graphics for advertising the particular products positioned within the chest cooler.

In still another embodiment of the present display stand, the front panel of the present display stand may also include a pair of optional channel members which are positioned adjacent the peripheral edge portion of the front panel, the pair of channel members being positioned and located so as to engage the opposed side edge portions of a changeable graphic panel which can be slidably positioned therebetween thereby mounting the graphic panel in overlaying relationship to the outer surface of the front panel. This arrangement enables a merchant to easily and conveniently change the graphic panel associated with the front portion of the present display stand so as to be compatible with the particular brand of products being merchandised from the cooler chest. All of these features are particularly important to merchants because they enhance the accessibility to the customer of any product displayed therein and more effectively utilize available merchandising floor space. Because of these capabilities, the present merchandising unit is particularly advantageous for use in supermarkets, convenient stores, grocery outlets, drug and liquor stores, fast food outlets and a wide variety of other wholesale and retail stores.

It is therefore an object of the present invention to provide an efficient and attractive product merchandising display unit adaptable for merchandising a wide variety of chilled products therefrom.

Another object is to provide a display stand which is relatively simple to assemble and inexpensive to manufacture.

Another object is to provide a display stand which is collapsible to a substantially flat folded configuration for ease of shipment and storage.

Another object is to provide a display stand which can be quickly and easily converted into a point-of-sale display unit.

These and other features and advantages of the present invention will be apparent to those skilled in the art after considering the following detailed specification in conjunction with the accompanying drawings.

BRIEF DESCRIPTION OF THE DRAWINGS

For a better understanding of the present invention, reference may be made to the accompanying drawings in which.

DETAILED DESCRIPTION OF THE PREFERRED EMBODIMENTS OF THE INVENTION

Figure 1:
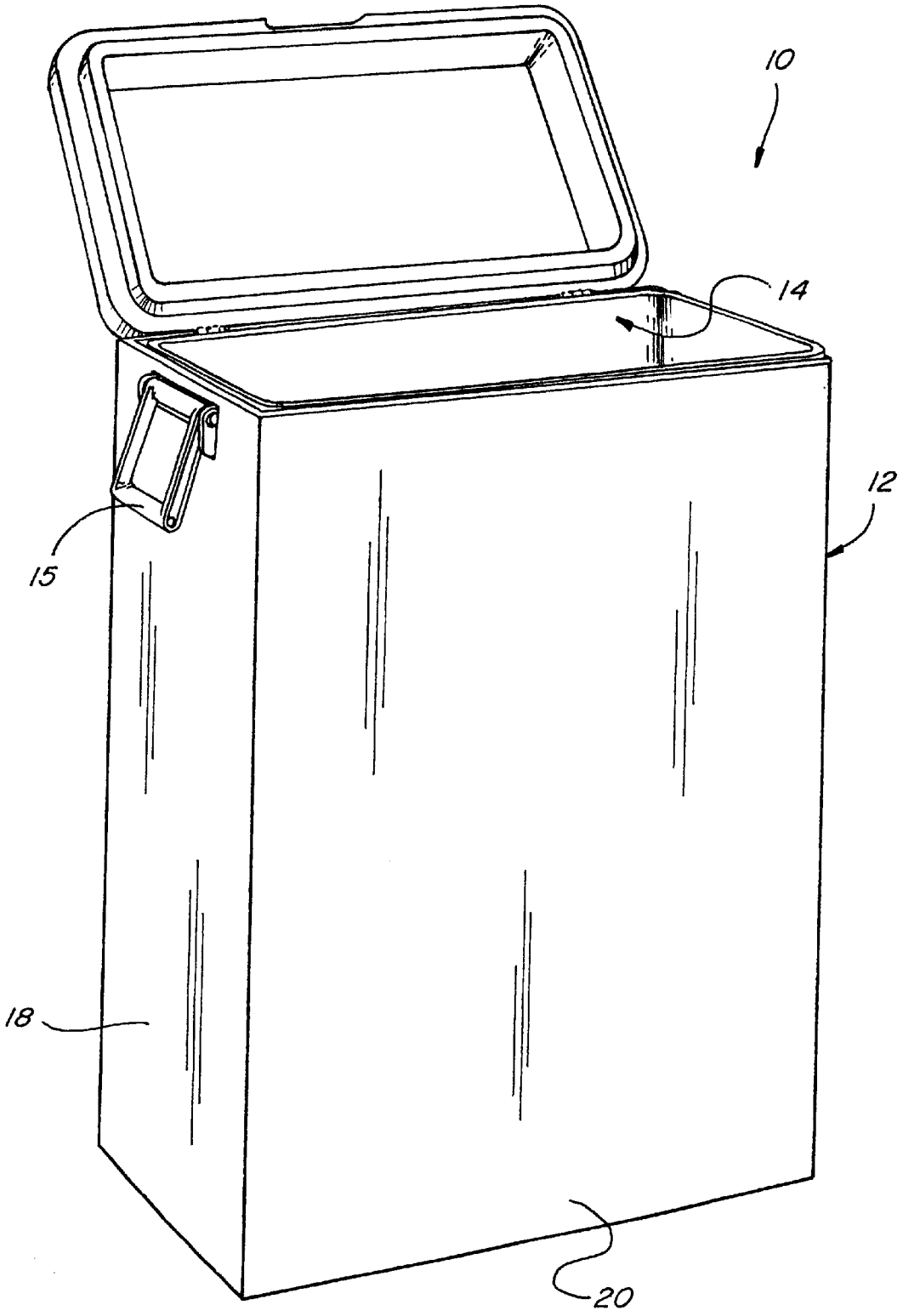
FIG. 1 is a perspective view of one embodiment of the present display stand in combination with a conventional cooler chest positioned therewithin.

Referring to the drawings more particularly by reference numbers wherein like numerals refer to like parts, number 10 in FIG. 1 identifies one embodiment of the present display stand 12 in conjunction with a conventional cooler chest 14 which is insertably positionable therewithin as illustrated. The present stand 12 is specifically designed and constructed to accommodate any conventional cooler chest such as those coolers manufactured by such companies as COLEMAN, IGLOO, RUBBERMAID and others, regardless of the size and shape thereof. It is also recognized and anticipated that the dimensions of the present display stand 12 can be varied so as to be compatible with the specific size and shape of the particular cooler 14 selected for use therewith. Although the present display stand 12 will be described in conjunction with accommodating a substantially rectangular cooler chest such as the cooler chest 14 illustrated in FIG. 1, it is likewise recognized and anticipated that the present display stand 12 can be constructed to accommodate cooler chests and other product holding containers having a wide variety of different shapes such as containers having a circular, square, triangular, and other polygonal shapes.

Figure 2:
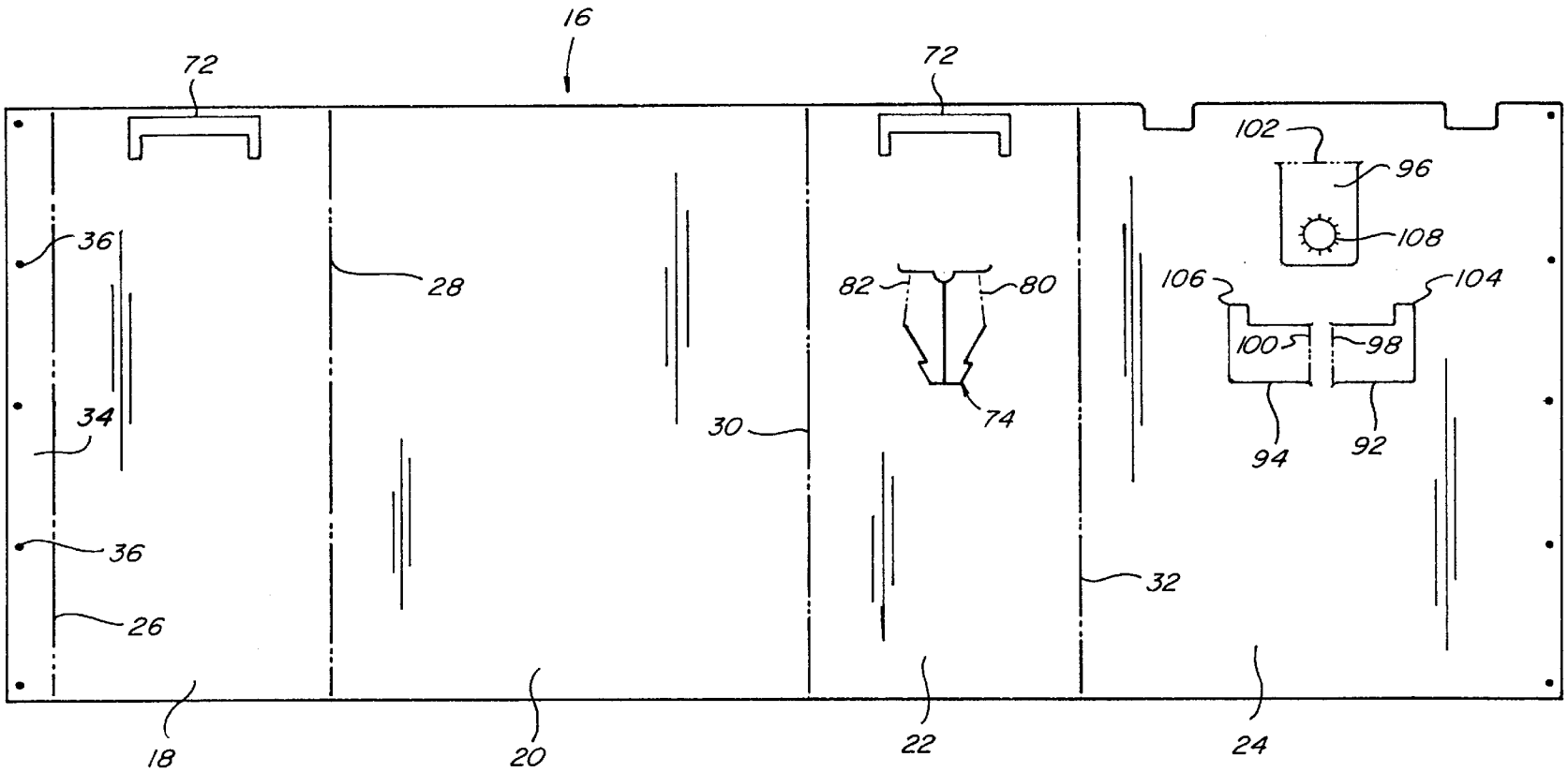
FIG. 2 is a top plan view of the main component forming the present display stand, this component being foldable so as to form the substantially rectangular shell illustrated in FIG. 1.
Figure 3:
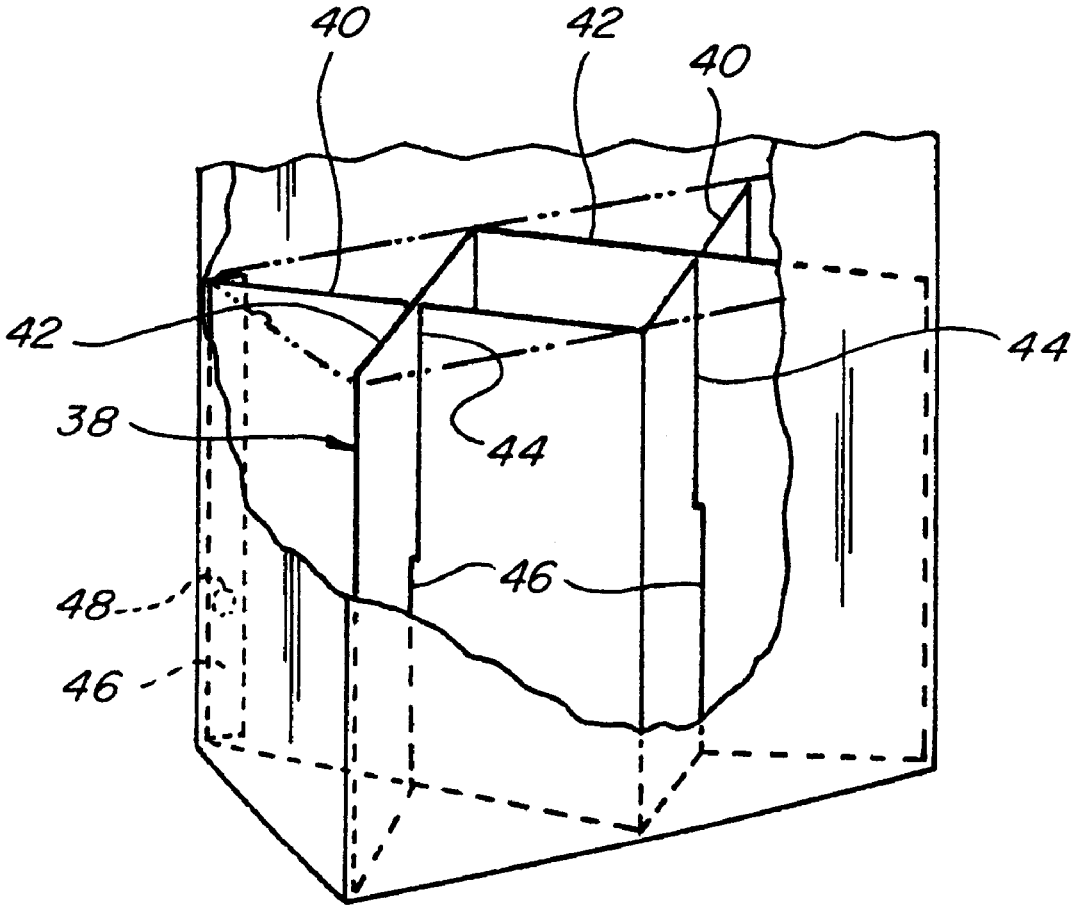
FIG. 3 is a partial cut away view of the lower portion of the present display stand of FIG. 1 showing the construction of one embodiment of the support structure positionable within the assembled shell, the support structure being adaptable for supporting a floor member and a conventional cooler chest when positioned thereon.
Figure 4:
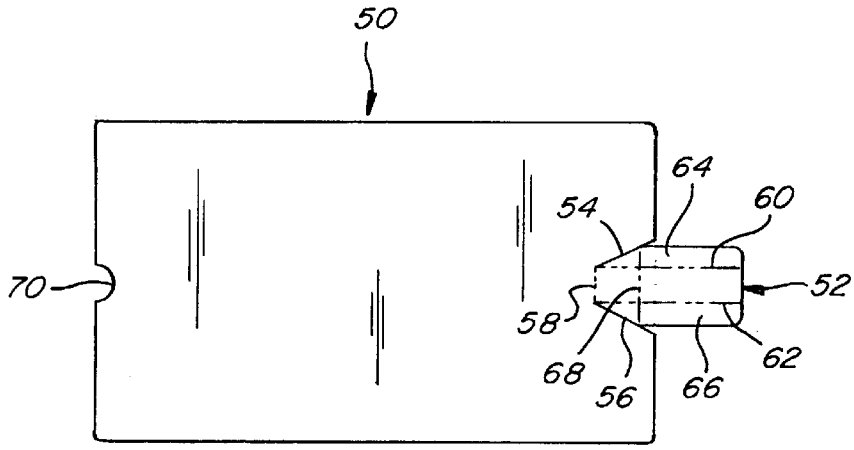
FIG. 4 is a top plan view of the floor member and its associated drain spout or trough.

As best illustrated in FIGS. 2, 3 and 4, the present display stand 12 includes a main foldable or bendable board member 16 (FIG. 2) which forms the outer shell of the present display stand 12 and wraps around the cooler 14, a support structure 38 (FIG. 3) for supporting the cooler chest 14 when positioned within the display stand 12, and a floor member 50 (FIG. 4) which is positionable on top of the support member 38 and provides a substantially smooth surface for holding the cooler chest 14 in proper position within the display stand 12. In a preferred embodiment, all of the members 16, 38 and 50 are formed from sheets of board material, preferably corrugated flexible plastic board material, although it is recognized and anticipated that other lightweight materials including uncorrugated board materials may likewise be utilized so long as such materials provide a stable, durable and rugged display stand capable of holding and supporting a particular cooler chest 14 as well as the weight of the product and ice positioned therewithin.

Referring, more particularly, to FIG. 2, the present display stand 12 is formed primarily through the use of the board member 16 which is shown in its initial flat form as a generally rectangularly shaped sheet of a board type material which is scored or otherwise weakened on one side thereof to define at least four foldable side panels 18, 20, 22 and 24, the panels being defined by score lines 26, 28, 30 and 32 respectively. The sheet 16 is also shown to include an additional somewhat narrow panel 34 adjacent one end portion thereof, the panel 34 being utilized so as to partially overlap panel 24 when the sheet member 16 is formed into the rectangular configuration illustrated in FIG. 1. In this regard, the sheet member 16 is foldable along score lines 26, 28, 30 and 32 into a substantially rectangular shell, the size of which is compatible for mating and receiving therewithin the cooler chest 14. When assembled into its rectangular shape, side panel 20 will form the front panel of the display stand 12, side panel 24 will form the rear panel of the present display stand, and side panels 18 and 22 will form the respective side panels thereof. Panels 24 and 34 each include a plurality of spaced apart apertures 36 which are correspondingly positioned and located on the respective panels 24 and 34 such that when the sheet member 16 is formed into its rectangular shape, the panel 34 will overlap one edge portion of panel 24 such that the apertures 36 will correspondingly mate and be in registration with each other. Any suitable fastening means may then be utilized to attach or otherwise connect panel 34 to panel 24 so as to hold sheet member 16 in its rectangular form. In an alternative embodiment, the sheet member 16 may be pre-formed into its rectangular or other configuration such that the opposed end portions of panels 24 and 34 are pre-attached or otherwise unitary in construction, the pre-formed member 16 including the necessary fold or score lines to achieve the desired configuration. These score or fold lines will also enable this alternative pre-formed shell embodiment to be collapsible or foldable for ease of shipment and storage.

Once sheet member 16 is assembled into its rectangular configuration, a support structure 38 as best illustrated in FIG. 3 is positioned and located within the opening or cavity formed by the rectangular shell adjacent the lower portion thereof. The support structure 38 is provided so as to provide support to the cooler chest 14 when the cooler 14 is positioned within the rectangular wraparound shell formed by sheet member 16. Although support structure 38 is illustrated as being a criss-cross accordion style member, it is recognized and anticipated that any support structure configuration which will adequately hold and support the cooler 14 when positioned thereon can be utilized with the present invention. In this regard, the support structure 38 as illustrated in FIG. 3 is typically comprised of two separate members 40 and 42, each member including a slot extending partially across the length-thereof such as the slots 44 and 46 illustrated in FIG. 3, such slots being positioned and located so as to mate with each other at the juncture or intersection locations between the respective members 40 and 42. This particular arrangement allows foldable support member 42 to be easily slidably engaged with the support member 40. It is recognized and anticipated that other methods for cooperatively engaging support members 40 and 42 are likewise possible including other support structure configurations as previously discussed.

The height of the support structure 38 from the bottom of display stand 12 is dimensioned such that the upper edge portion of the cooler 14, when opened, will lie substantially close to the upper edge portion of the display stand 12 as best illustrated in FIG. 1. Although the support structure 38 will rest upon the floor surface associated with a particular merchandising location, or some other support surface, it is preferred, although not required, that the support structure 38 be at least minimally attached to the shelf member 16 for ease of transporting the entire display stand 12 with cooler 14 from one merchandising location to another. This attachment can be accomplished using any suitable fastening means such as by simply attaching a portion of the support structure 38 to overlap panel 34 via one of the apertures 36. In this regard, support member 40 may include an overlapping flange portion 46 having at least one aperture 48 associated therewith, the aperture 48 being positioned and located so as to lie in registration with one of the apertures 36 when the support member 38 is positioned within the display stand 12. Other suitable attachment means can likewise be utilized such as using VELCRO type fastening means, or other types of adhesive means.

Figure 6:
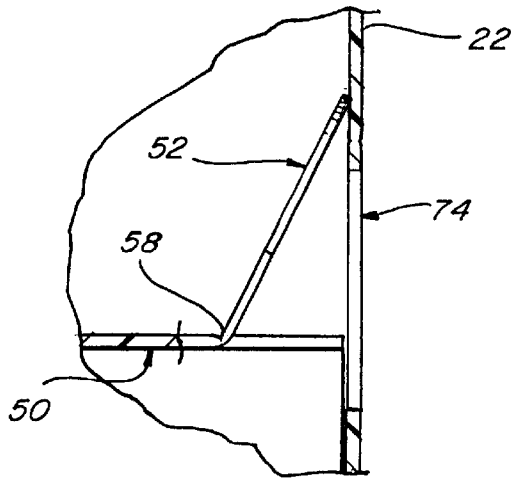
FIG. 6 is a partial cross-sectional view of the display stand of FIG. 1 showing the drain trough in a stored position within the interior of the present display stand.
Figure 7:
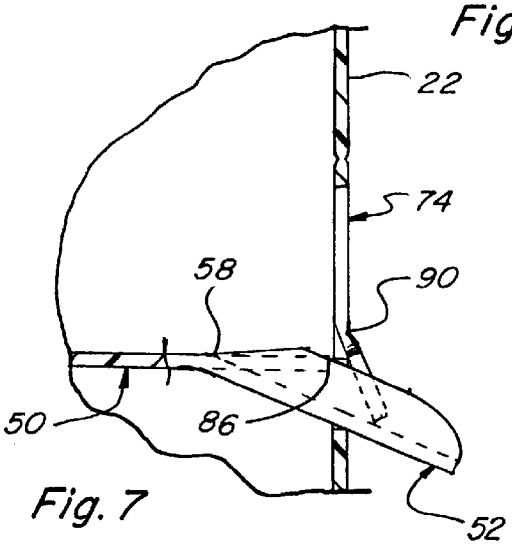
FIG. 7 is a partial cross-sectional view similar to FIG. 6 showing the drain trough in its fully extended and operative position extending through the opening formed by the door assembly of FIG. 5.

FIG. 4 illustrates the floor member 50 which is positionable on top of the support structure 38 for providing a substantially smooth flat surface for the cooler chest 14 to rest upon. The floor member 50 is sized and dimensioned so as to fit within the opening defined by the rectangular wraparound shell formed by sheet member 16 and includes an extension portion 52 which can be shaped and formed into a drain spout or trough for emptying the waste water which accumulates within the cooler 14 from the melting ice. The floor extension portion 52 is severed along lines 54 and 56 and is pivotally movable along score line 58. This allows the drain spout or trough 52 to be easily positioned in its stored or storage position as illustrated in FIG. 6, or in its operative position as illustrated in FIG. 7. Floor extension portion 52 likewise includes longitudinally extending score lines 60 and 62 which allow flap portions 64 and 66 to be foldable so as to form a trough for channeling the chilled waste water from the cooler 14 to a suitable container or receptacle positioned exterior of and adjacent to the display stand 12. An additional transverse score line 68 is likewise provided so as to add additional flexibility and bendability to the trough extension member 52 for more conveniently maneuvering such member between its stored and operative positions as illustrated in FIGS. 6 and 7. The trough extension member 52 is positioned and located so as to mate with a drain plug associated with the cooler chest 14 and the floor member 50 further includes a notch 70 which is provided to facilitate installation of the member 50 within the wraparound shell formed by member 16. In this regard, when the floor member 50 is initially positioned within the display stand 12, the trough extension member 52 is typically positioned within the interior of the display stand 12 in its storage position as illustrated in FIG. 6 as this presents a more pleasing appearance to consumers when they view the merchandising unit 10, particularly side panel 22.

Once floor member 50 is properly positioned within the display stand 12 as illustrated in FIG. 6, the cooler chest 14 can be insertably positioned therewithin. In this regard, panel members 18 and 22 (FIG. 2) each include a respective cutout 72 which is sized and dimensioned so as to enable one of the handle members 15 associated with the cooler 14 to be inserted therethrough, each handle member 15 being thereafter accessible exterior of the display stand 12 as shown in FIG. 1. The cutouts 72 are positioned and located on board member 16 so as to lie in substantial alignment and/or registration with the handle members 15 of cooler 14 when the board member 16 is formed into the outer shell of display stand 12 and when the cooler 14 is positioned within the shell and supported by the members 38 and/or 50. This allows a user or merchant to easily grasp the entire product merchandising unit 10 via the handle members 15 for transporting the entire unit 10 from one merchandising location to another.

Figure 5:
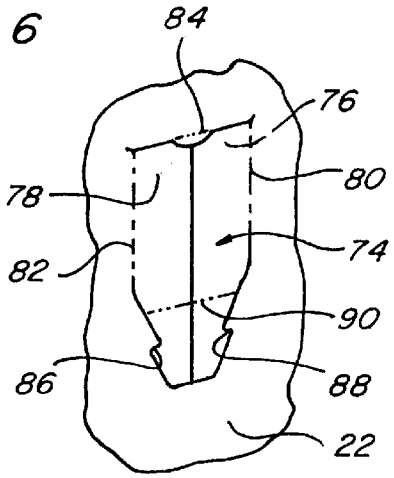
FIG. 5 is a partial side elevational view of one side panel of the assembled display stand showing a door assembly formed therein for receiving therethrough the drain trough associated with the floor member of FIG. 4.

Panel 22 of sheet member 16 likewise includes a drain door assembly 74 as best shown in FIGS. 2 and 5 which can be easily opened, when desired, to allow the drain trough extension member 52 to extend through the opening formed thereby. The drain door assembly 74 is positioned and located on panel 22 so as to lie in substantial alignment and/or registration with the drain trough 52 and includes two movable door portions 76 and 78. The door portions 76 and 78 are hindedly bendable or foldable about score lines 80 and 82 respectively whereas the remaining edge portions of each respective door portion 76 and 78 are severed from panel 22. This allows door portions 76 and 78 to be easily maneuvered to their respective open positions as illustrated in FIG. 7. In this regard, a finger notch 84 (FIG. 5) is provided for facilitating the opening of the drain door assembly 74. When the drain trough 52 is maneuvered so as to extend through the drain door assembly 74, the upper edge portion of the respective flap portions 64 and 66 will engage the respective lip portions 86 and 88 (FIGS. 5 and 7) so as to maintain the trough 52 in its proper orientation. In this regard, drain door assembly 74 likewise includes a transverse score line 90 extending across both door portions 76 and 78 about which the lower portion of the respective doors 76 and 78 can pivot and/or bend as illustrated in FIG. 7 to again present a somewhat pleasing appearance to customers viewing side panel 22. When the drain trough 52 is extended through the opening formed by door assembly 74, the respective doors 76 and 78 can again be maneuvered to their substantially closed positions such that the respective upper portions thereof will again lie substantially flush with side panel 22 and only the respective lower portions thereof will be positioned away from panel 22. In this regard, the lower portion of the respective doors 76 and 78 are each respectively shaped so as to substantially lie within the trough area formed by the trough 52 as again illustrated in FIG. 7.

Since the drain trough 52 is positioned so as to lie in substantial alignment with the drain plug associated with a typical cooler chest 14, a user can extend his/her hand through the door assembly 74 to release the drain plug and allow the waste water which has accumulated within the cooler 14 to exit the cooler and flow down the drain trough 52 to a suitable container positioned exterior of the display stand 12 adjacent the terminal end portion of the drain trough 52. At selected intervals, the cooler chest 14 can be empty of accumulated waste water through the use of the drain trough 52. When the cooler 14 is completely drained, the drain door assembly 74 is opened, the cooler drain plug is closed, and the drain trough 52 is positioned inside the display stand 12 as illustrated in FIG. 6 by squeezing the flap portions 64 and 66 forming the upstanding side walls of the trough together and thereafter bending the trough member 52 upwardly about score line 68 so as to position the member 52 within the interior of display stand 12 as illustrated in FIG. 6. The drain door assembly 74 is thereafter closed again presenting an aesthetic appearance to approaching consumers.

It is also recognized and anticipated that the support structure 38 can be used without the floor member 50. In this regard, the cooler chest 14 will rest directly upon the top surface of the support structure 38. In fact, the support structure 38 can take on a wide variety of different shapes and sizes so long as such structure can adequately support the cooler 14 at the proper position within the display stand 12. In this particular situation, other means for draining and/or removing the waste water which accumulates within the cooler 14 will be implemented such as removing the cooler 14 from within the display stand 12 to accomplish this task. Other drain arrangements are likewise contemplated.

Figure 8:
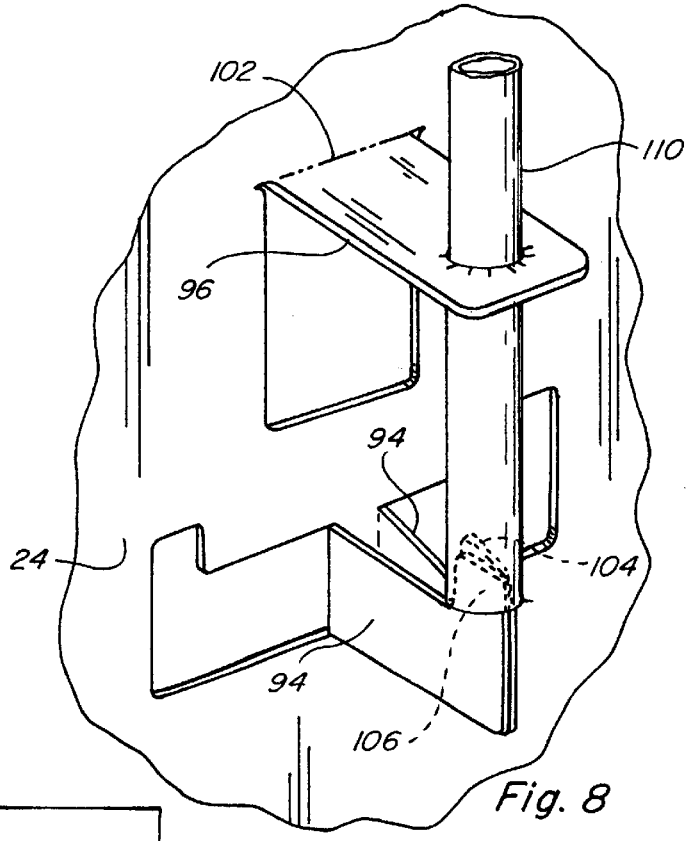
FIG. 8 is a partial perspective view of the rear panel of the assembled display stand of FIG. 1 showing the positioning of a plurality of flap members for engaging and holding a pole sign for advertising particular products positioned within the cooler chest.

FIG. 8 illustrates a method for conveniently holding a pole sign adjacent the rear panel 24 of the display stand 12. A typical pole sign will include a pole having a tubular passage associated therewith such as the partial pole 110 illustrated in FIG. 8 and a sign member (not shown) having product graphics associated therewith. As illustrated in FIG. 2, panel 24 of sheet member 16 includes three flange or flap members 92, 94 and 96 which are severed on all sides thereof except for the respective sides defined by the respective score lines 98, 100 and 102. The flap members 92, 94 and 96 are therefore hingedly pivotable about score lines 98, 100 and 102 as best illustrated in FIG. 8. Flap members 92 and 94 each respectively include an upwardly extending tab portion 104 and 106, whereas flap member 96 includes an opening 108 extending therethrough adaptable for receiving the pole associated with a typical pole sign such as the pole 110 illustrated in FIG. 8. As best illustrated in FIG. 8, flap member 96 is pivotally rotated to a substantially horizontal position relative to the floor surface and flap members 92 and 94 are pivotally rotated to a substantially perpendicular position relative to the planar surface of panel 24. In this position, the respective tabs 104 and 106 are shaped and dimensioned so as to extend upwardly into the tubular cavity or passageway associated with at least one end portion of the pole 110 so as to engage the pole 110, the pole 110 being further supported by the upper edge portions of the flap members 92 and 94 where such peripheral edge portions engage the lower edge portion of pole member 110. When a pole sign is not used, the respective flap members 92, 94 and 96 can be pivotally rotated to respective positions wherein all such flap members lie substantially flush with the planar surface of panel 24. Use of the plurality of flap members 92, 94 and 96 provides a simple and effective way for adequately supporting a pole type sign for advertising the particular products being merchandised from cooler 14. Although each flap member 92 and 94 is illustrated as including a respective tab portion 104 and 106, it is recognized and anticipated that the pole sign may be adequately supported if only one of the flap members 92 and 94 included a tab portion. In this situation, the other flap member 92 or 94 may be engaged with the flap member including the tab portion so as to further support and stabilize the engagement of the tab portion with the pole 110. It is also recognized that any plurality of flap members 92 and 94 may be utilized to engage and support the bottom end portion of the pole 110 including using only one such flap member.

Figure 9:
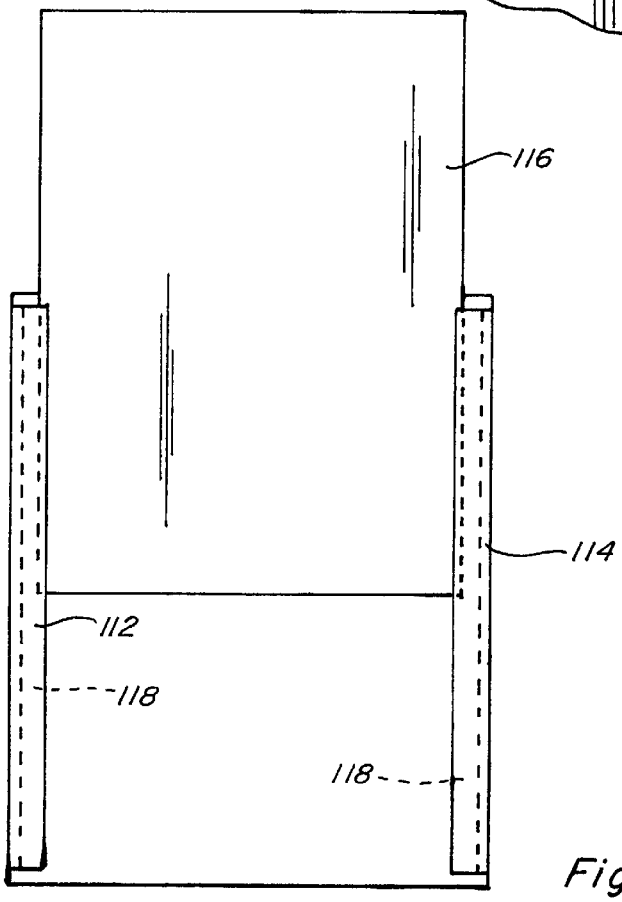
FIG. 9 is a front elevational view of the present display stand showing use of a pair of optional channel members for removably interchanging a plurality of different graphic panels, one such graphic panel being shown in partial engagement with the channel members during installation thereof.

It is anticipated that the exterior surface of any of the plurality of panels 18, 20, 22 and 24 of sheet member 16 may include permanent graphics to advertise specific products positioned within cooler 14. It is also recognized that the present merchandising unit 10 can be utilized to display and merchandise a wide variety of different chilled products as well as a wide variety of different product brands. In this regard, at least the front panel 20 of sheet member 16 may include means in the form of channel members 112 and 114 as illustrated in FIG. 9 for mounting any one of a plurality of different graphic and advertising change panels such as the changeable display panel 116 likewise illustrated in FIG. 9. The channel members 112 and 114 each include a channel, slot, groove or other means 118 for cooperatively receiving and engaging one edge portion of the panel member 116 such as the respective side edge portions thereof. In this regard, the change panel 116 is a planar member of rectangular shape so as to substantially overlay the outer surface of the front panel 20 of sheet member 116. Each change panel such as the change panel 116 can include advertising messages and graphic images (not shown) on one or both of the opposite surfaces thereof and the panel 116 can be mounted on the display stand 12 with either surface facing outwardly for display purposes. Each panel 116 is preferably made of a flexible material and each is sufficiently resilient so as to return to a planar position when flexed or bent and released, which capability can facilitate its installation and engagement with channel members 112 and 114. The channel members 112 and 114 are preferably adhesively attached to the side edges of panel 20, and such members are preferably provided separate from sheet member 116 such that the user or merchant can adhesively attach such members to the outer surface of panel 20 if so desired.

Although the various components of the present display stand 12 can be fabricated from any suitable lightweight board type material including both corrugated and uncorrugated board material, it is preferred that the board type material be corrugated, and, more particularly, it is preferred that the material construction be a corrugated plastic board material since such materials offer various degrees of stability, strength and resistance to wear and damage during use. Also, corrugated board material demonstrates the requisite flexibility for folding and bending along score lines and provides the need strength and stiffness as well as the desired properties of resistance to wetting, washability and adaptation to reuse. In addition, if necessary, the members 16, 38 and 50 are collapsible to a substantially flat foldable configuration for ease of shipment and storage.

Still further, although the present display stand 12 has been described and disclosed with respect to a substantially rectangular cooler chest 14, it is recognized and anticipated that the cooler 14 or any other suitable product holding container may be fashioned into a variety of different sizes and shapes including a square, circular, triangular and other shapes, and that the internal components of the present display stand assembly may likewise be correspondingly shaped to conform to the particular shape of the cooler chest 14 without departing from the teachings and practice of the present invention. In this regard, more or fewer score lines such as the score lines 26, 28, 30 and 32 may be needed in any particular embodiment and the handle cutouts 72, the drain door assembly 74, and the plurality of flap members 92, 94 and 96 may be positioned and located differently depending upon the resulting configuration of the sheet member 16 when it is formed into its final wraparound shell configuration. In addition, since the changeable display panels 116 are preferably made of a flexible material, such panels 116 will flex and bend so as to conform to the particular configuration of the particular shell portion over which they will be mounted. Still further, the display stand 12 can likewise be used in combination with a product holding container to hold and merchandise unchilled products and in such a situation, the present display stand 12 can likewise be used with or without the floor member 50. In this particular embodiment, if the floor member 50 is not used, the product holding container will rest directly on top of the support structure 38. As a result, the present display stand 12 provides a simple, efficient, adaptable, reusable, and accessible point-of-sale display admirably suited for merchandising both chilled and unchilled products therefrom when the cooler chest 14 or some other suitable product holding container is positioned therewithin. The simplicity, durability, flexibility, and versatility of the present display stand 12 greatly increases its usefulness and effectiveness for encouraging and promoting point-of-purchase sales.

Thus, there has been shown and described a novel display stand for use in displaying and merchandising products, which display stand, in combination with a conventional cooler chest or other suitable container, fulfills all of the objects and advantages sought therefore. Many changes, modifications, variations and other uses and applications of the present cooler assembly will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A display stand for supporting a container adaptable for merchandising products therefrom, said display stand comprising a sheet of material having top, bottom and opposed side edges, said sheet of material being bendable so as to form a shell having an opening associated therewith adaptable for receiving the container, a support structure positionable within the shell opening adaptable for supporting the container when positioned thereon, said support structure being located relative to said shell such that the container is substantially housed within said shell when the container is positioned within the shell opening, and a member having a floor portion for engaging at least a portion of the container, said floor portion including a portion formable into a drain trough for channeling waste water which may accumulate within the container to a suitable receptacle positioned exterior of the display stand, said sheet of material including a drain door positioned and located so as to lie in registration with the drain trough associated with said floor portion when said sheet of material is formed into said shell, said drain door being positionable as to allow the drain trough to extend through the opening formed by said drain door.

2. The display stand defined in claim 1 including fastening means for attaching the opposed side edges of said sheet when said sheet is formed into said shell.

3. The display stand defined in claim 1 wherein said sheet of material is pre-formed into a one-piece shell configuration.

4. The display stand defined in claim 1 wherein said support structure is attachable to said sheet of material when positioned within the shell opening.

5. The display stand defined in claim 1 wherein said support structure includes at least two interconnecting members.

6. The display stand defined in claim 1 wherein the container includes a pair of handle members, said sheet of material including a pair of cutouts positioned and located so as to lie in registration with the pair of handle members associated with the container when said sheet of material is formed into said shell and when the container is supported by said support structure.

7. The display stand defined in claim 1 including a pole sign having product graphics associated therewith, said sheet of material including a plurality of flap members which are positionable to hold and support said pole sign when engaged therewith.

8. The display stand defined in claim 1 wherein the container is a substantially rectangular ice chest, and wherein said sheet of material is bendable so as to form a substantially rectangular shell which is conformable to the substantially rectangular shape of the container.

9. The display stand defined in claim 1 wherein said sheet of material is comprised of a flexible material.

10. The display stand defined in claim 1 wherein said sheet of material is comprised of a corrugated flexible plastic board material.

11. The display stand defined in claim 1 including a graphic panel member and a pair of channel members for mounting said panel member in overlaying relationship to the outer surface of the shell formed by said sheet of material, said graphic panel member having opposed side edge portions, said pair of channel members being attachable to the outer surface of the shell formed by said sheet of material in opposed relationship so as to engage the opposed side edge portions of said graphic panel member when said panel member is slidably positioned therebetween.

12. The display stand defined in claim 1 wherein said support structure is comprised of a corrugated flexible plastic board material.

13. The display stand defined in claim 1 wherein said floor portion is comprised of a corrugated flexible plastic board material.

14. A display stand for supporting a cooler chest adaptable for merchandising products therefrom, the cooler chest having a plurality of side walls associated therewith, said display stand comprising a first member having top, bottom and opposed side portions, said first member being foldable so as to form a shell defining a cavity adaptable for receiving the cooler chest, a second member positionable within said shell cavity adaptable for supporting the cooler chest when positioned thereon, and a third member positionable within said shell cavity for resting upon said second member, said third member providing a floor surface for engaging and holding the cooler chest, said third member including opposed side portions and an extension portion associated with one of said opposed side portions, said extension portion being foldable to form a drain spout adaptable for receiving and channeling waste water which may accumulate within the cooler chest to a suitable container positioned exterior of said display stand.

15. The display stand defined in claim 14 wherein said first, second and third members are formed of a flexible board material.

16. The display stand defined in claim 14 wherein said second member is comprised of two cooperatively engageable members.

17. The display stand defined in claim 14 wherein said first member includes a door member operable to allow said drain spout to be positioned through the opening formed by said door member, said drain spout being pivotally movable between a storage position wherein said drain spout is positioned and located within the shell formed by said first member and an operative position wherein said drain spout extends through the opening formed by said door member.

18. The display stand defined in claim 14 including a pole sign, said pole sign including a pole having a tubular passageway associated with at least one end portion thereof and a sign member having product graphics associated therewith, said first member including a plurality of pivotally movable flap members which are positionable to hold and support said pole sign, at least one of said plurality of flap members including an opening extending therethrough adaptable for receiving the pole associated with said pole sign, and at least one of said plurality of flap members including an upwardly extendable tab portion which is shaped and dimensioned to extend into the tubular passageway of the pole associated with said pole sign at one end portion thereof.

19. The display stand defined in claim 14 including a changeable display panel and means for mounting said display panel in overlaying relationship to the outer surface of the shell formed by said first member, said display panel having opposed top and bottom edge portions and opposed side edge portions, said mounting means including opposed channel means positioned on the outer surface of said shell for cooperatively engaging at least portions of the side edge portions of said display panel, said display panel being slidably movable within said opposed channel means.

20. The display stand defined in claim 14 wherein the cooler chest includes a pair of handle members, said first member including a pair of cutouts positioned and located so as to lie in substantial alignment with the pair of handle members associated with the cooler chest when said first member is formed into said shell and when the cooler chest is positioned on said third member.

21. The display stand defined in claim 14 including fastening means for attaching the opposed side end portions of said first member when said first member is formed into said shell.

22. A display stand for supporting a cooler chest adaptable for merchandising products therefrom wherein the cooler chest includes a pair of handle members and a plurality of side walls, said display stand comprising a first member having top, bottom and opposed side portions, said first member being foldable so as to form a shell which is conformable to the shape of the cooler chest, a second member positionable within said shell adaptable for supporting the cooler chest when positioned thereon, and a third member positioned within said shell for resting upon said second member, said third member including opposed side portions and providing a substantially flat surface for holding the cooler chest, said third member being positioned and located within said shell such that the side walls of the cooler chest are substantially hidden from view when the cooler chest is positioned on said third member, said third member further including an extension portion associated with one side portion thereof, said extension portion being foldable to form a drain trough adaptable for receiving and channeling waste water away from the cooler chest, said first member including at least one pivotally movable flap member positioned and located so as to lie in registration with said drain trough when said first member is formed into said shell, said at least one flap member being movable so as to allow said drain trough to extend through the opening formed by said at least one flap member, said first member further including a pair of cutouts positioned and located so as to lie in substantial alignment with the pair of handle members associated with the cooler chest when said first member is formed into said shell and when the cooler chest is positioned on said third member, the cooler chest handle members being positionable so as to extend through said pair of cutouts.

23. The display stand defined in claim 22 wherein said first, second and third members are formed of a flexible board material.

24. A display stand for supporting a container adaptable for merchandising products therefrom, said display stand comprising a sheet of material having top, bottom and opposed side edges, said sheet of material including means for weakening said sheet at various locations therealong, said weakening means enabling said sheet to be bendable so as to form a shell having an opening associated therewith adaptable for receiving the container, a support structure positionable within the shell opening adaptable for supporting the container when positioned thereon, said support structure being located relative to said shell such that the container is substantially housed within said shell when the container is positioned within the shell opening, and a pole sign having product graphics associated therewith, said sheet of material including a plurality of flap members which are positionable to hold and support said pole sign when engaged therewith.

25. A display stand for supporting a container adaptable for merchandising products therefrom, said display stand comprising a sheet of material having top, bottom and opposed side edges, said sheet of material including means for weakening said sheet at various locations therealong, said weakening means enabling said sheet to be bendable so as to form a shell having an opening associated therewith adaptable for receiving the container, a support structure positionable within the shell opening adaptable for supporting the container when positioned thereon, said support structure being located relative to said shell such that the container is substantially housed within said shell when the container is positioned within the shell opening, and a graphic panel member and a pair of channel members for mounting said panel member in overlaying relationship to the outer surface of the shell formed by said sheet of material, said graphic panel member having opposed side edge portions, said pair of channel members being attachable to the outer surface of the shell formed by said sheet of material in opposed relationship so as to engage the opposed side edge portions of said graphic panel member when said panel member is slidably positioned therebetween.

26. A display stand for supporting a cooler chest adaptable for merchandising products therefrom, the cooler chest having a plurality of side walls associated therewith, said display stand comprising a first member having top, bottom and opposed side portions, said first member being foldable so as to form a shell defining a cavity adaptable for receiving the cooler chest, a second member positionable within said shell cavity adaptable for supporting the cooler chest when positioned thereon, and a third member positionable within said shell cavity for resting upon said second member, said third member providing a floor surface for holding the cooler chest, said third member being positioned and located within said shell cavity such that said shell wraps around the side walls of the cooler chest when the cooler chest is positioned on said third member, said third member further including opposed side portions and an extension portion associated with one of said opposed side portions, said extension portion being foldable to form a drain spout adaptable for receiving and channeling waste water which may accumulate within the cooler chest to a suitable container positioned exterior of said display stand, said first member including a door member operable to allow said drain spout to be positioned through the opening formed by said door member.

27. A display stand for supporting a cooler chest adaptable for merchandising products therefrom, the cooler chest having a plurality of side walls associated therewith, said display stand comprising a first member having top, bottom and opposed side portions, said first member forming a shell defining a cavity adaptable for receiving the cooler chest, a second member positionable within said shell cavity adaptable for supporting the cooler chest when positioned thereon, and a third member positionable within said shell cavity for providing a floor surface for holding at least a portion of the cooler chest, said third member including a portion formable into a drain spout for channeling waste water which may accumulate within the cooler chest to a suitable container positioned exterior of the display stand, said first member including a door member operable to allow said drain spout to be positioned through the opening formed by said door member.

28. The display stand defined in claim 27 wherein said drain spout is pivotally movable between a storage position wherein said drain spout is positioned and located within the shell formed by said first member and an operative position wherein said drain spout extends through the opening formed by said door member.

29. A display stand for supporting a container adaptable for merchandising products therefrom, the container including a pair of handle members, said display stand comprising a sheet of material having top, bottom and opposed side edges, said sheet of material being bendable so as to form a shell having an opening associated therewith adaptable for receiving the container, a support structure positionable within the shell opening adaptable for supporting the container when positioned thereon, said support structure being located relative to said shell such that the container is substantially housed within said shell when the container is positioned within the shell opening, and a member having a floor portion for engaging at least a portion of the container, said floor portion including a portion formable into a drain trough for channeling waste water which may accumulate within the container to a suitable receptacle positioned exterior of the display stand, said sheet of material including a pair of cutouts positioned and located so as to lie in registration with the pair of handle members associated with the container when said sheet of material is formed into said shell and when the container is supported by said support structure.

* * * * *